United States Patent [19]

Murray, Jr. et al.

[11] 3,974,796

[45] Aug. 17, 1976

[54] DUAL MODE APPARATUS FOR DEVELOPING LATENT ELECTROSTATIC IMAGES

[75] Inventors: Gerald J. Murray, Jr., Arcadia; Gordon U. Klingenberg, Bloomington, both of Calif.

[73] Assignee: Xerox Corporation, Stamford, Conn.

[22] Filed: Nov. 21, 1974

[21] Appl. No.: 525,697

[52] U.S. Cl. ..... 118/4; 118/DIG. 5; 118/309; 118/629; 118/637; 427/185

[51] Int. Cl.[2] ..... G03G 15/08

[58] Field of Search ..... 118/DIG. 5, 309, 627, 118/629, 637, 4; 355/3 DD; 427/21, 185

[56] References Cited

UNITED STATES PATENTS

| | | | |
|---|---|---|---|
| 3,169,886 | 2/1965 | Simm | 118/629 |
| 3,640,246 | 2/1972 | Jeromin et al. | 118/637 |
| 3,646,910 | 3/1972 | Cade et al. | 118/629 |
| 3,842,801 | 10/1974 | Larson et al. | 118/637 |
| 3,861,354 | 1/1975 | Muntz et al. | 118/629 |

OTHER PUBLICATIONS

U.S. Published Patent Application B323666 1/28/75 Jeromin, L.S.

*Primary Examiner*—Louis K. Rimrodt
*Assistant Examiner*—Douglas Salser
*Attorney, Agent, or Firm*—J. E. Beck; T. J. Anderson; A. W. Karambelas

[57] ABSTRACT

A powder cloud development apparatus is provided for developing latent electrostatic images on the surface of an insulating member, normally a photoconductive layer, employing a powder cloud development system. The development apparatus is operable in either a positive or negative mode and includes a development electrode comprising a plurality of spaced substantially parallel wires, a gap, or open section, which is formed between selected groups of these wires, the wires being connected at each end to a continuous loop drive mechanism. The parallel wires therefore or the gap may either be presented in operable relationship to the surface of the insulating member in order to provide either electroded or non-electroded development in the negative and positive modes respectively.

28 Claims, 7 Drawing Figures

DUAL MODE APPARATUS FOR DEVELOPING LATENT ELECTROSTATIC IMAGES

BACKGROUND OF THE INVENTION

Xeroradiography, as disclosed in U.S. Pat. No. 2,666,144, is a process wherein an object is internally examined by subjecting the object to penetrating radiation. A uniform electrostatic charge is deposited on the surface of a xerographic plate and a latent electrostatic image is created by projecting the penetrating radiation, such as X-rays or gamma rays, through the object and onto the plate surface. The latent electrostatic image may be made visible by contacting the latent electrostatic image on the plate surface with fine powdered particles (toner) electrically charged opposite to the latent electrostatic image pattern on the plate in order to develop a positive image (in order to develop a negative image, the toner is of the same polarity as the latent electrostatic image pattern). The visible image may be viewed, photographed or transferred to another surface where it may be permanently affixed or otherwise utilized. The entire processing is dry, and no drak room is necessary.

Xeroradiography in recent years has been utilized to examine the extremities, the head, and to detect breast cancer in women. In examination of breasts wherein soft tissue comprises most of the breast area, xeroradiography, or xeromammography as it is generally called, provides greater resolving power than the conventional roentgenographic film and greater image detail is achieved. A wide range of contrast is seen on the xeroradiographic plate as compared to the conventional roentgenographic films so that all the structures of the breast from the skin to the chest wall and ribs may be readily visualized. Besides providing better contrast, xeromammography detects small structures like tumor calcification and magnifies them more than conventional film, is quicker, less expensive, gives greater detail and requires less radiation than prior nonphotoconductive X-ray techniques.

The technique of powder cloud development, as disclosed in U.S. Pat. No. 2,711,481, has been utilized to develop xeroradiographic plates. This development technique is preferred in xeroradiography because discontinuities in the object being examined are readily developed. The charged surface of the plate is disposed facing a chamber area in which a cloud of powder particles are introduced. In the positive mode of development, the particles must be charged opposite to the polarity of the charge on the plate so that the particles may deposit upon the surface of the plate in an image configuration due to the action of the electrostatic forces of the latent electrostatic image of the plate acting on the charged particles in the powder cloud. In the negative imaging mode, toner of the same polarity as the latent image is attracted to the plate by means of the plate substrate voltage. Various prior art techniques for charging the powder cloud include turbulently flowing the powder particles in air through a nozzle, tube or the like to triboelectrically charge the particles or by passing the particles through a corona discharge area comprising a fine needle or fine wire and a grounded exectrode as disclosed in U.S. Pat. No. 2,725,304.

U.S. Pat. No. 3,640,246 describes a powder cloud apparatus for developing latent electrostatic images wherein an ion cloud and powder cloud are introduced into the development chamber through opposite walls and meet under a baffle, extending between the opposed walls, whereby the clouds are thoroughly mixed. A development, or grid, electrode, positioned between the plate carrying the latent electrostatic image and the baffle, is included, the grid being utilized to control image contrast and quality. The grid, by appropriate biasing during the development cycle, separates particles charged to an undesired polarity and accelerates the particles of the desired polarity to the surface of the photoconductor.

The development chamber described in the aforementioned patent, although satisfactory in most respects, has certain deficiencies associated therewith. For example, utilization of the stationary close spaced grid electrode reduces image quality due to the tendency of lines developing on the image as a result of focusing the particles through the stationary grid wires. Further, the grid wires, after a relatively long development cycle, accumulates toner thereon, impairing the effectiveness of the grid by reducing toner penetration through the grid due to the narrowing of wire to wire spacing. Although periodic cleaning of the stationary grid wires would minimize the aforementioned problem, it has been found that providing a movable cleaning mechanism to periodically contact and clean the stationary grid wires usually complicates the development cycle and increases the costs associated therewith. Further, since it has been determined that certain types of xeroradiographic images are of higher quality when a development grid, or electrode, is not present during imaging whereas other types of images require the presence of the development electrode, the prior art development chamber is obviously limited to the latter imaging technique.

SUMMARY OF THE INVENTION

The present invention provides novel apparatus for developing a latent electrostatic image formed on the surface of an insulating member. In particular, a cloud of charged developer particles is introduced into a development chamber through a first port in the chamber wall and gas is introduced through a second port in the chamber wall directly opposite said first port. A baffle is positioned above the ports and below the surface of the insulating member. The development apparatus is operable in either a positive or negative mode and includes a development electrode comprising a plurality of spaced, substantially parallel wires; a gap, or open section, being formed between selected ones of said wires, the wires being connected at each end to a continuous loop drive mechanism. In the negative development mode, the drive mechanism is energized, the development electrode thereby being driven past the insulating surface, the upper plane of the wire travel being closely spaced from the insulating surface. The wires are electrically biased in the development area and the wire to wire spacing with respect to wire diameter is sufficiently large to allow the passage of toner therethrough. The portion of the development electrode which is not in the image area adjacent the insulator surface is movably directed in a manner whereby there is no interference with development. A stationary cleaning system, located without the development area, cleans the wires as the wires are directed therethrough. The development electrode drive mechanism may be connected to a variable speed motor to allow optimization of the electrode speed.

In the positive mode of operation, the drive mechanism is not energized and the development electrode is positioned whereby the gap is substantially coextensive with the insulating surface.

A movable cleaning system for cleaning the upper surface of the baffle and the bottom of the development chamber is also provided.

It is an object of the present invention to provide improved apparatus for developing latent electrostatic images formed on the surface of an insulating member.

It is a further object of the present invention to provide improved apparatus for developing latent electrostatic images formed on the surface of an insulating member wherein a cloud of charged toner particles are mixed with a gas under a baffle, the mixture being directed to said insulating surface via a development, or grid electrode, which comprises a plurality of substantially parallel wires.

It is still a further object of the present invention to provide improved apparatus for developing latent electrostatic images formed on the surface of an insulating member wherein a cloud of charged toner particles are mixed with gas under a baffle, the mixture being directed to said insulating surface via a biased, movable development electrode which comprises a plurality of spaced, substantially parallel wires, a gap, or open section, being formed between selected ones of said wires, the wires being connected at each end to a continuous loop drive mechanism.

It is an object of the present invention to provide apparatus for developing latent electrostatic images formed on the surface of an insulating member in either a first or second mode wherein a cloud of charged toner particles are mixed with gas under a baffle, the mixture being directed to said insulating surface through a movable development electrode which comprises a plurality of spaced, substantially parallel wires, a gap, or open section, being formed between selected ones of said wires, the wires being connected at each end to a continuous loop drive mechanism, the development electrode being driven past the insulating surface in the first mode, the upper plane of the electrode wire travel being closely spaced from said insulating surface, and the development electrode being positioned whereby the gap is substantially coextensive with the insulating surface in the second mode.

It is still an object of the present invention to provide apparatus for developing latent electrostatic images formed on the surface of an insulating member in either a first or second mode, wherein a cloud of charged toner particles are mixed with gas under a baffle, the mixture being directed to said insulating surface via a movable development electrode which comprises a plurality of spaced, substantially parallel wires, a gap, or open section, being formed between selected ones of said wires, the wires being connected at each end to a continuous loop, variable speed drive mechanism, the development electrode being driven past the insulating surface in the first mode in a manner whereby said wires are electrically biased, the upper plane of the electrode wire travel being closely spaced from said insulating surface, and the development electrode being positioned whereby the gap is substantially coextensive with the insulating surface in the second mode.

It is a further object of the present invention to provide improved apparatus for developing latent electrostatic images formed on the surface of an insulating member in either a first or second mode, wherein a cloud of charged toner particles are mixed with gas under a baffle, the mixture being directed to said insulating surface via a movable electrode which comprises a plurality of spaced, substantially parallel wires, a gap, or open section, being formed between selected ones of said wires, the wires being connected at each end to a continuous loop drive mechanism, the development electrode being driven past said insulating surface in a first mode whereby said wires are electrically biased, the development electrode being positioned whereby the gap is substantially coextensive with said insulating surface in the second mode, the upper surface of the baffle and the chamber bottom being cleaned by a movable cleaning system and the electrode wires being cleaned at a stationary cleaning station remote from said insulating surface.

DESCRIPTION OF THE DRAWINGS

For a better understanding of the invention as well as further objects and features thereof, reference is made to the following description which is to be read in conjunction with the accompanying drawings wherein.

DESCRIPTION OF THE PREFERRED EMBODIMENT

Figure 1:
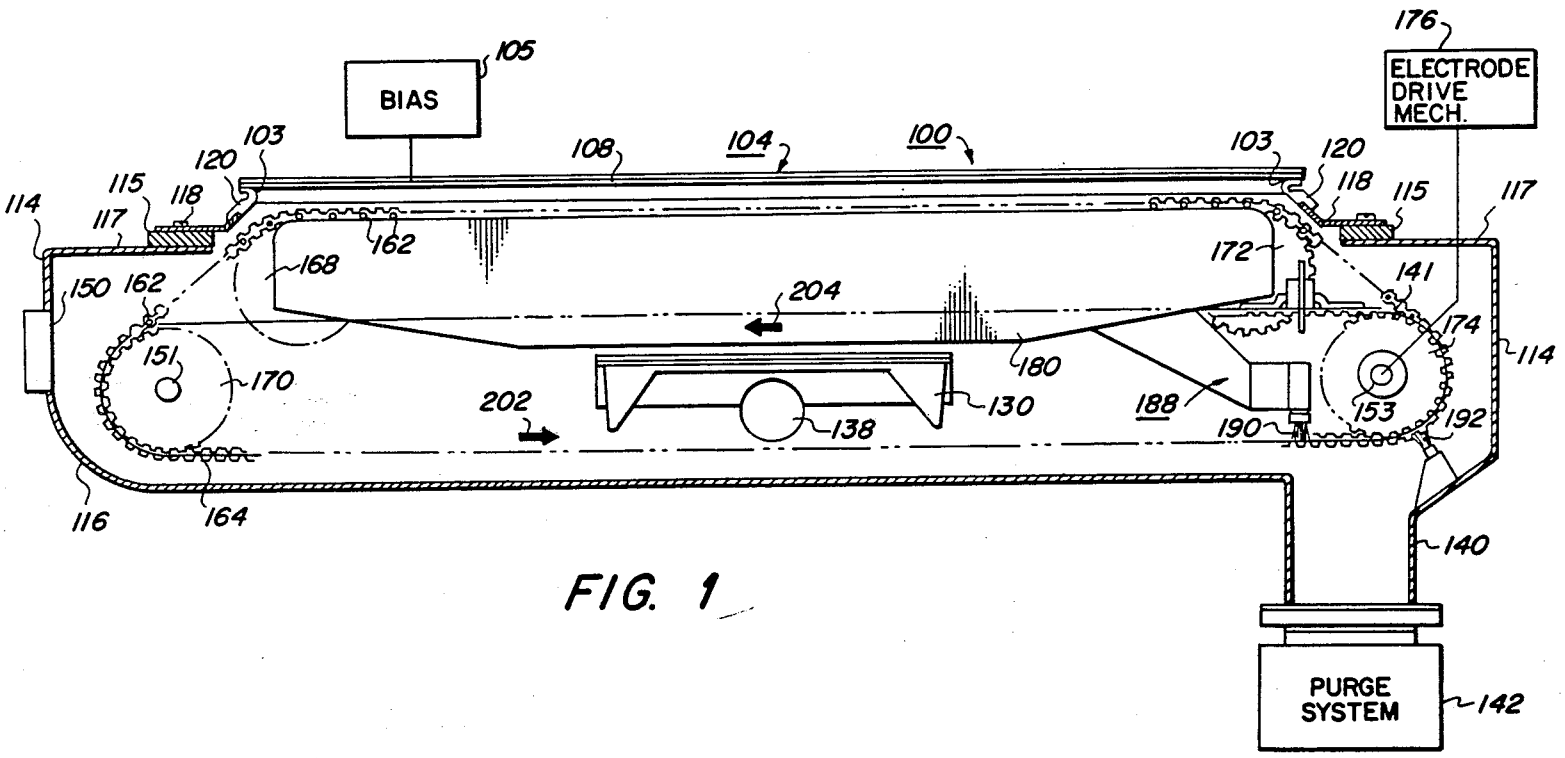
FIG. 1 is a simplified cross-sectional view of a powder cloud development apparatus incorporating the teachings of the present invention.
Figure 2:
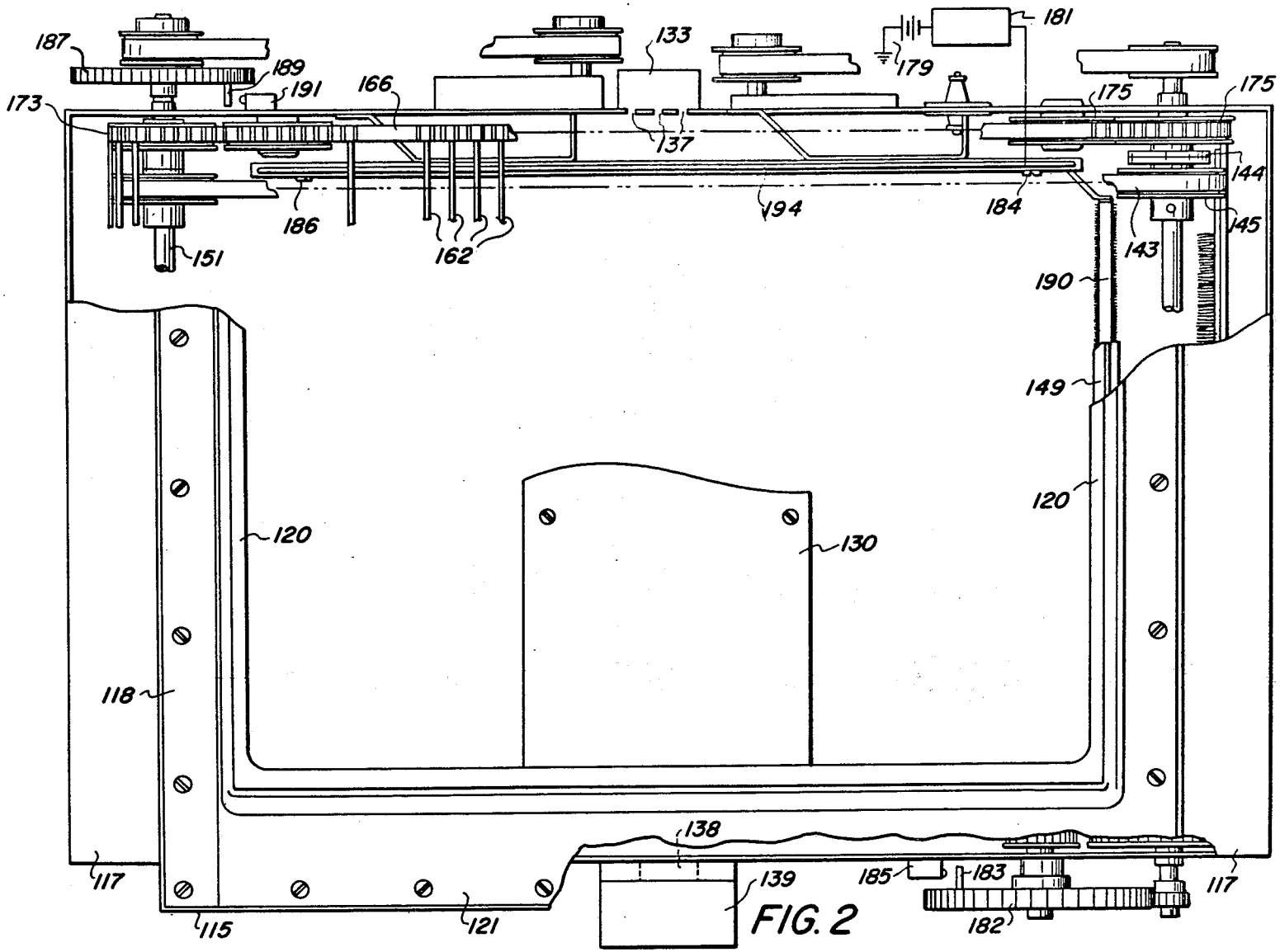
FIG. 2 is a top plan view of the development apparatus of FIG. 1 with the xeroradiographic plate removed.
Figure 3:
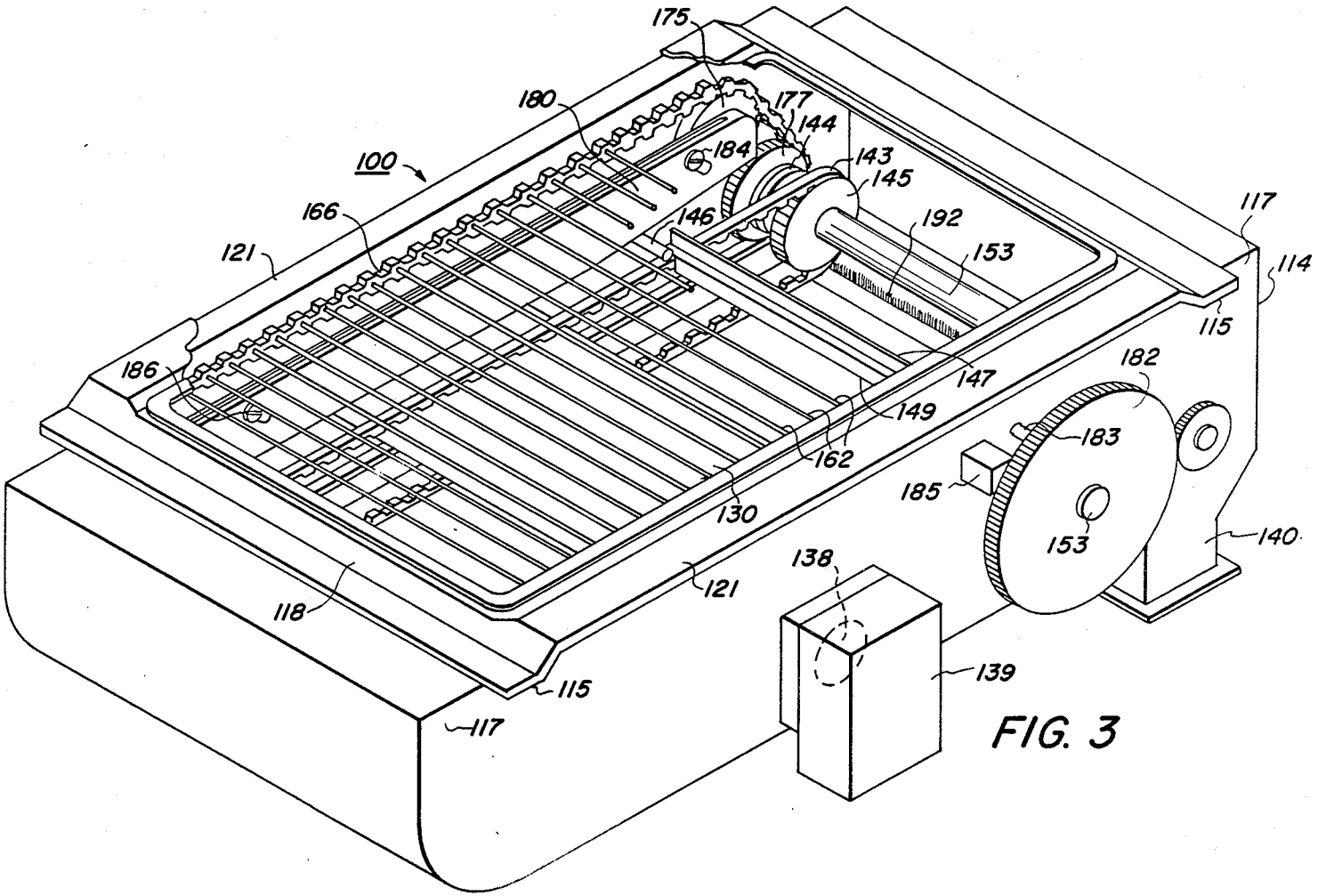
FIG. 3 is a perspective view, partially in cross-section, of the development apparatus of the present invention.

Initially referring to FIGS. 1-3, development means 100 includes a xerographic plate 104 having a conductive backing member 106 and downwardly facing photoconductive layer 108 therein. The development means described herein may be utilized in the automated flat plate xerographic processing system decribed in U.S. Pat. No. 3,650,620. As more fully described in the '620 patent, means are provided to advance a latent electrostatic imagebearing xerographic plate into the development means and to advance the xerographic plate out of the development means after the latent electrostatic image has been converted to a corresponding xerographic powder image. Portions of the '620 patent which are necessary for complete understanding of the present invention or to provide sufficient disclosure to understand the more fully automated operation of the development chamber described herein are incorporated by reference.

The sidewalls 114 and 116 of development chamber 100 terminate, about the upper periphery thereof, in an inwardly extending lip 117. A gasket supporting member 118 having a gasket (or seal) 120 on the upper portion thereof is attached to lip 117 via support member 115. Xerographic plate 104 is positioned by appropriate transport mechanisms adjacent the development station, the xerographic plate being lowered by elevator means (not shown) such that gasket 120 and felt strips 121 is caused to seat against the non-photoconductive portions 103 of the conductive backing member 106 whereby a toner tight development chamber is defined.

Below the xerographic plate and mounted on a support bracket (not shown) is a canopy-shaped baffle 130 which is electrically grounded. Pressurized gas, such as air, from source 133 is introduced into the development chamber through a plurality of air intake holes, or ports, 137 located in one wall of the development chamber, the gas exiting to that portion of the development chamber beneath baffle 130. Extending through the side wall of the development chamber directly opposite ports 137 is a toner entrance port 138, also positioned beneath baffle 130. Port 138 is connected to powder cloud generator 139, shown in simplified form. A powder cloud generator which may be utilized in the present invention is disclosed in U.S. Pat. No. 3,648,901.

A purge duct 140 is located in the bottom wall of the development chamber through which unused toner is withdrawn during the purge cycle via a purge system 142 comprising a filter and blower means (not shown). At the beginning of the purge cycle, the blower is in communication with the development chamber through the toner filter means and duct 140 whereby unused air borne toner is withdrawn from the development chamber. After the purge cycle, the purging means is removed from communication with the development chamber.

In order to provide automatic and sequential cleaning of the upper surface of baffle 130 and the chamber bottom, a dual wiper blade system is provided. This system comprises a parallel pair of toothed, or notched, belts 141 and 143, each driven by a pair of timing pulleys, only timing pulley 145 being shown in FIG. 3, and wiper blades 147 and 149 mounted to belts 141 and 143 as shown. The timing pulleys are mounted on the same shafts 151 and 153 which drive the development electrode described hereinbelow, whereby the two systems are driven simultaneously, at predetermined times within the cycle as will be explained hereinafter, when clutch 144 is engaged. An electrically operable stop, or anchor, 146 is provided to maintain the wiper in a home, or initial, position until the cleaning sequence is initiated. After an initial purge cycle is completed, wiper blades 147 and 149 automatically clean, in sequence, the top of baffle 130 and the chamber bottom after the wiper drive pulley 145 is caused to rotate. A subsequent purge cycle is initiated after the wiper blade assembly cleans the baffle and chamber bottom.

The development chamber 100 of the present invention incorporates a development, or grid, electrode which comprises a series of parallel wires 162 connected perpendicularly at each end to continuous loop drive members 164 and 166. The parallel wires 162 may comprise any conductive material, such as stainless steel, aluminum, chromium, etc., the typical diameter thereof being approximately 0.060 inches. The effectiveness of the development electrode is dependent on the wire to wire spacing which, in a preferred embodiment, is approximately 0.375 inches. The spacing can be relatively large with respect to the wire diameter to allow the toner to pass easily therethrough.

Xeroradiographic imaging techniques, as utilized in the field of medical diagnostics, may be divided into two general categories, general radiography and mammography. The first category includes images of the extremities, the skull, chest, etc. whereas the latter category relates to imaging of the breast. It has been determined that images of high quality in the first category are obtained when the development electrode is caused to move past the photoconductive surface 108 during the development cycle. In this mode of operation, a negative potential of 2000 volts, for example, is placed on the electrode wires 162 via potential source 179 and voltage divider 181 while a variable negative potential (in the range from approximately 3800 volts to about 4200 volts) is placed on the conductive backing member, or substrate, 106 via bias means 105.

In the second category of imaging, it has been determined that high quality images are produced when no development electrode is utilized. In this mode of operation, a positive potential of approximately 2000 volts is applied to conductive substrate 106 via bias means 105.

Figure 4:
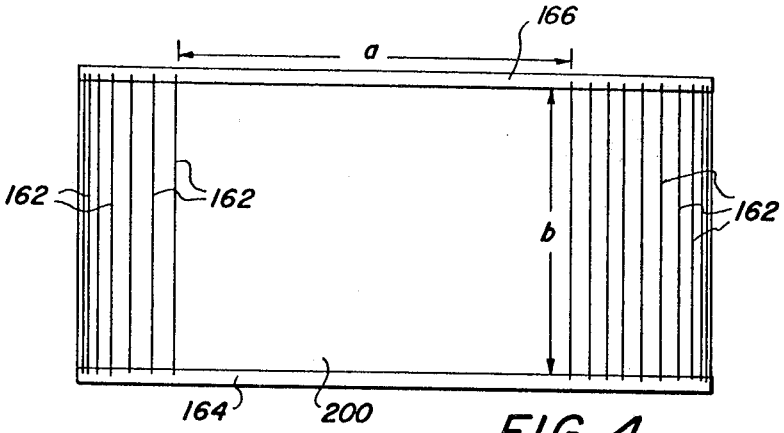
FIG. 4 illustrates the layout of the development electrode structure.

In order to provide this dual mode capability, the development electrode has a gap, or an open section 200, shown in layout form in FIG. 4. As will be explained hereinafter, when the system is in the positive mode of operation, the electrode is in the home position and disengaged from the drive pulley, the open portion 200 of the electrode being substantially coextensive with the surface of the photoreceptor. The open section, or gap, is approximately 13.5 inches long (dimension *a*) and 9.5 inches wide (dimension *b*) corresponding to the image area on the photoconductive surface.

The continuous loop drive members 164 and 166 each comprise a pair of toothed, or notched, timing belts (or chains) driven by a pair of pulley systems, the first system (corresponding to continuous loop member 164) pulleys 166, 168, 170 and 172, the second pulley system (corresponding to continuous loop member 166) comprising pulleys 171, 173, 175 and 177, each pulley having a notched circumference to interact with and drive the associated continuous loop member. In the simplified embodiment illustrated, drive mechanism 176, which in the preferred embodiment comprises a variable speed motor to allow control of the development electrode velocity, (typically 5 inches/sec.) is coupled to pulley 174 which functions as the development electrode drive pulley. Gear member 182, having switch actuating pin 183 thereon, is mounted to drive shaft 153. Development electrode home switch 185, mounted to the development chamber, positioned to be operatively engageable with pin 183, as will be explained in more detail hereinafter with reference to FIG. 7, pin 183 actuating switch 185 once each revolution of shaft 153.

An adjustable grid cam 180 is provided to allow the upper plane of grid wire travel to be closely spaced (0.2 inches, for example) to the surface of photoreceptor 108. Since the position of the grid cam is adjustable by adjusting screws 184 and 186 within their associated slots, the spacings between the upper plane of the grid wire travel and the photoreceptor surface can be varied to obtain a developed image with image contrast/density control. It should be noted that if the cam is adjusted to a value different than the initial setting, appropriate steps should be taken to adjust the belt (or chain) to either provide additional belt (or chain)

length or, conversely, take up any slack which may result.

The portion of the development electrode which is not in the image area (the portion of the photoconductive surface 108 exposed to the mixture of toner and air) is routed by cam 180 and the appropriately positioned pulleys 168, 170, 172 . . . as shown in a manner whereby image development is not affected by the development electrode traversals.

A stationary cleaning system 188 comprising inner grid wire cleaning brush 190 and outer grid wire cleaning brush 192 cleans the grid wires as they pass therebetween, the cleaning station 188 being located so as not to interfere with image development.

As shown in FIGS. 2 and 3, a commutator strip 194 is formed on the upper surface of adjustable cam 180 and extends at least the length of the development area (dimension a, FIG. 4) and is provided when a rubber timing belt is utilized to bias the electrode wires 162 with the potential from source 179 as the wires traverse the development area. If a chain drive system with sprockets is utilized, the system should be insulated from ground (biasing of the chain drive system may be accomplished by providing a brush contact at a selected location). In the preferred embodiment, the drive mechanism is located outside the toner development area leaving only the electrode wires suspended through the toner development area to avoid toner contamination of the drive mechanism.

Development means 100 is of the powder cloud type wherein a fine cloud of charged toner particles is created by a powder cloud generator (not shown) as disclosed in U.S. Letters Pat. Nos. 2,812,833 or 2,862,646 and blown into the development chamber 100 through port 138. The powder cloud and gas meet under baffle 130 and are thoroughly mixed. Because of the flow rates of the powder cloud generator and the gas, the charged powder cloud within the development chamber is caused to swirl out from under baffle 130 toward the upper portion of the development chamber whereby the charged toner particles are attracted to the latent electrostatic image of the photoconductive layer 108 whereby the latent image is developed. In the preferred embodiment, the toner cloud generator is pulsed a plurality of times to fill the development chamber with a charge of toner particles. The air flow is preferably pulsed simultaneously with the toner (powder) cloud generator. Alternately, the air flow may be maintained at a constant rate.

At the end of the development cycle, i.e., after the toner is introduced into the development chamber, and during which the latent electrostatic image has been made visible by the attraction of oppositely charged toner particles, the development chamber automatically is in communication with the purge system to entrain unused toner via purge intake filter 150, and the airborne toner is collected in the filter bag within purge system 142. At the end of the purge cycle, the xerographic plate is removed from the development chamber to an image transfer station whereat the powder image on the plate is transferred to receiving material, such as paper.

The baffle 130, which defines the zone in which the toner cloud and the gas flow initially mix, is dimensioned and shaped to provide a uniform distribution of toner in the upper section of the development chamber as each cloud is moved out from under it during succeeding pulses of the toner and/or gas supply apparatus. In the preferred embodiment, the baffle extends completely between the opposed sidewalls. In general, this movement of the charge powder cloud is affected by the kinetic energy imposed on the toner particles from pulsing the powder cloud generator system and gas supply. The shape of the baffle should be such as to provide for proper charged powder cloud movement to the development zone adjacent the charged xerographic plate.

The parallel conducting elements 162, which are biased oppositely from the polarity of the latent-electrostatic image when it is desired to form a negatively sensed reproduction, is utilized to suppress particles which have the opposite polarity as the latent electrostatic image and to establish field lines normal to the photoconductive surface whereby the phenomenon of edge deletion can be controlled as desired. The biased conducting elements 162 also serve to accelerate the movement toward the photoconductive surface of positive particles between the conducting elements 162 and the photoconductive surface.

The accelerated cloud of particles is used in the development of the latent image. The development electrode also assists in controlling the contrast of the developed image by providing an electrostatic field to counteract the fringing fields associated with the edges between adjacent areas of varying charge density. This field causes the toner particles having the desired polarity of charge to move toward the photoconductive surface thereby increasing the effectiveness of the development process.

The magnitude of the bias applied to the conducting elements 162 may be varied by appropriate adjustment of voltage divider 181 whereby control of the positively charged toner particles can be achieved.

Figure 5:
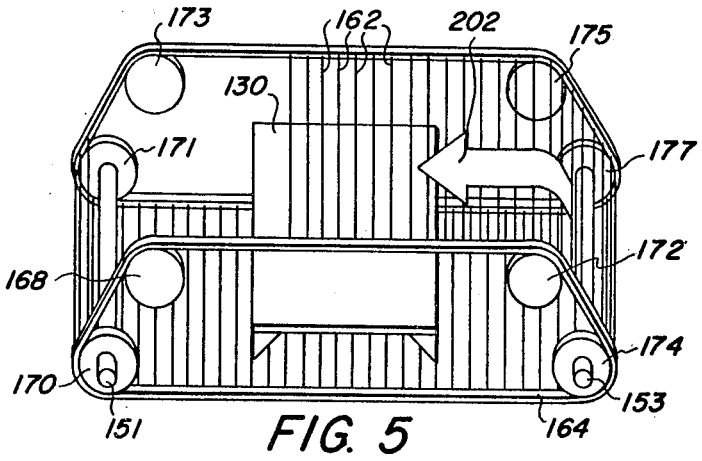
FIG. 5 is a simplified perspective view of the development chamber illustrating the development electrode traversing the xeroradiographic plate.
Figure 6:
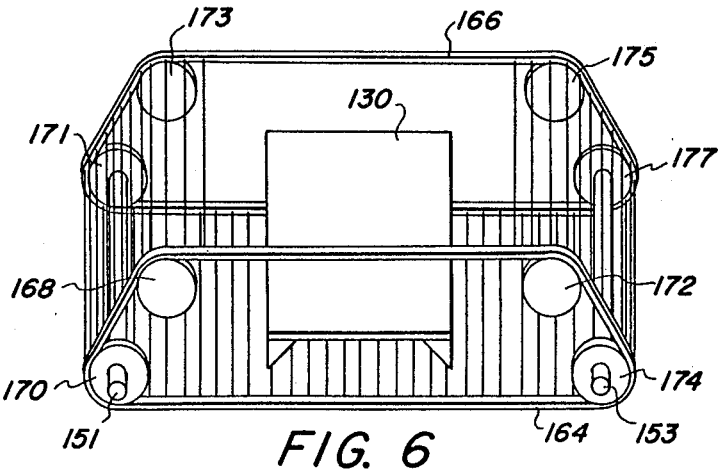
FIG. 6 is a perspective view of the development chamber showing the development electrode at the home position.
Figure 7:
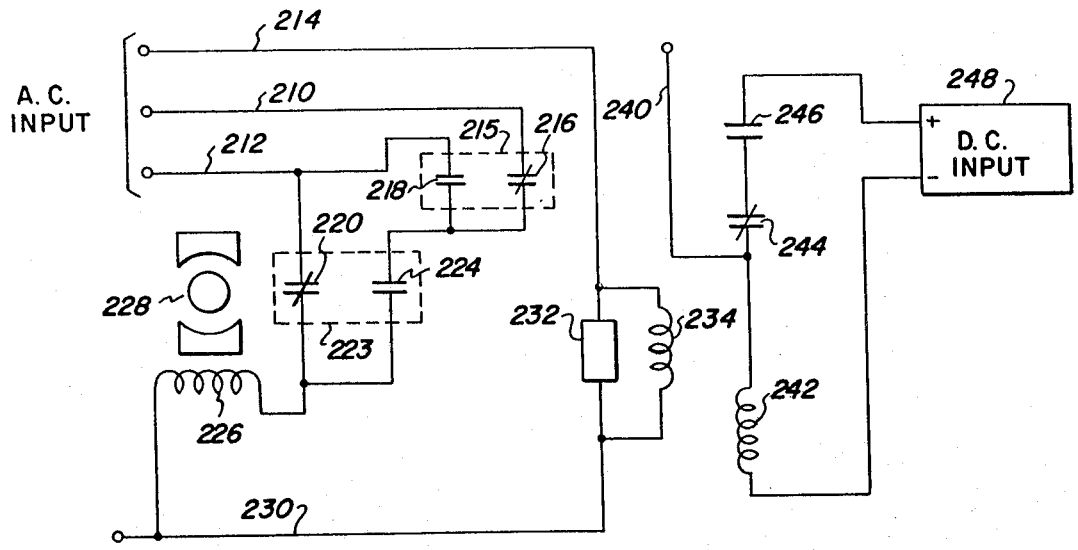
FIG. 7 is a schematic diagram of circuitry utilized to control the development apparatus of the present invention.

In operation, when switches associated with the development chamber indicate that the xerographic plate is in a toner tight relationship with the development chamber, the development cycle is initiated by activating master timing means (not shown). If the negative development mode is to be utilized, the appropriate biasing potentials are applied to the plate substrate 106 and the commutator strip 194 and the development electrode drive mechanism 176 is energized whereby the development electrode is caused to travel in the direction of arrow 202, as shown in FIGS. 1 and 5. Pressurized gas, such as air, is supplied in pulses to ports 137 and the toner powder cloud generator is similarly pulsed one or more times to fill the development chamber with a charge of toner particles, the pulsing of the air and toner particles being accomplished, in the preferred embodiment, simultaneously for improved cloud uniformity. The air and toner particles mix under baffle 130 and are directed to the surface of the photoconductor 108 to develop the latent electrostatic image as explained hereinabove. The development electrode, during development, continuously traverses the development chamber in the direction of arrow 202 to suppress undesirable deletions while the wiper drive system is disengaged and inoperative. At the end of the development cycle, the master timing means causes the development chamber to be in communication with the purge system 142; air drawn through filter 150 entraining unused airborne toner. In this manner, unused toner is purged from the development chamber. During the purge cycle, the development electrode seeks its "home" position (illustrated in FIG. 6), i.e. when gap 200 in the development electrode is substantially opposite the surface of the photoconductor 108. After purge is complete, the xerographic plate is removed from the chamber by elevator means (not shown). At this time, appropriate timing switches, as described hereinafter with reference to FIG. 7, are energized whereby the timing pulley which drives the wiper system is caused to engage with the development electrode drive pulley 174 via clutch 144. At this time, the development electrode drive pulley 174 is caused to rotate and both the wiper and development electrode are moved in the direction of arrow 204. The wiper blade system is mounted adjacent the gap 200 and returns to its home position as the development electrode returns to its home position shown in FIG. 6.

The wiper blade, after cleaning the top of baffle 130, reverses direction and moves in the direction of arrow 202, cleaning the chamber bottom as described in Copending Application Ser. No. 323,666, filed Jan. 15, 1973. The wiper blades 147 and 149 are mounted to the wiper blade assembly in a manner whereby wiper blade 147 extends through the gap on the development electrode as it travels in the direction of arrow 200 to allow cleaning of the chamber bottom.

In the positive development mode of operation, the timing pulley 174 which drives the development electrode is disengaged during development and the plate substrate is positively biased via biasing means 105. In this mode of operation, the development electrode remains at the "home" position during development. After the purge cycle, the plate is removed and the cleaning cycle is initiated in the same manner as described with the negative development mode. In this regard, the development electrode drive pulley is engaged so that the development electrode follows the wiper blade system as described previously.

Brushes 190 and 192 continually clean the inner and outer surfaces of the grid electrode wires 162, respectively, as the development electrode traverses the development chamber 100 in the direction of arrow 202. By limiting toner build-up on the grid wires, adverse affects on the operational characteristics of the development chamber can be virtually eliminated. After the cleaning cycle is completed, the powder images on the plate is subsequently transferred to a support sheet, the powder image is then permanently fused to the sheet, the plate then being cleaned and processed for subsequent reuse.

Referring now to FIG. 7, a schematic diagram illustrating the development apparatus operating sequence is illustrated.

External AC power, such as that provided by a three phase 117 volt source, is connected to lines 210, 212 and 214 as shown. Power on line 210 is provided by circuitry external to the development apparatus only during the negative development cycle. The development apparatus is placed in either the negative or positive development mode by positioning a switch (not shown) in either of two positions. In the first, or negative development mode, power is applied to lead 210. In the second, or positive development mode, power is not applied to lead 210. Power is present on line 212 when the apparatus incorporating the development apparatus of the present invention is turned on. Power is present on line 214 during the purge cycle.

Line 210 is coupled to the normally closed contacts 216 of a single pole double throw switch 215 and line 212 is coupled to the normally open contacts 218 of the same switch. Line 212 is also coupled to normally closed switch contacts 220 of single pole double throw switch 223. The other side of contacts 216 and 218 are connected to the normally open switch contact 224, part of switch 223. The other side of contacts 220 and 224 are connected to one side of armature 226 of grid drive motor 228 (electrode drive mechanism 176 shown in FIG. 1), the other side of armature 226 being connected to AC return line 230. Line 214 is connected relay 232 and solenoid 234.

Line 240, which receives power from circuitry external to the development apparatus, is coupled to solenoid 242 and to normally closed contacts 244 of mechanical switch 191 (FIG. 3). Contacts 244 are connected to normally open contacts 246 of relay 232. A source of DC voltage 248 supplies voltage to solenoid 242 and line 240 as will be explained hereinafter.

In operation, assuming the system incorporating the present invention is on, that the development cycle is being initiated and that the development electrode is not in the home position, power is supplied to lines 210 and 212. In the negative mode of development, the power on line 210 is conducted by normally closed contacts 216 and contacts 224 to the armature 226 of motor 228, initiating the movement of the development electrode across the photoreceptor surface as described hereinabove. It should be noted that normally open contacts 224 are closed when the development electrode is at the "home", or initial position, contacts 224 being closed (actuated) by pin 183 on gear member 182 (FIG. 3) once for each complete revolution of the development electrode. Note that the initial position can be selected by adjusting pin 183 or switch 185 to actuate contacts 224 accordingly. Power on line 210 will be maintained until the last burst of toner, the development electrode seeking the initial position subsequent to the last toner burst.

When the development electrode is off the initial position, power is provided to motor 228 on line 212 through contacts 220.

In the positive mode of development, power is not supplied to line 210 and the development electrode is maintained at the initial position throughout the development cycle.

During the purge cycle, power is supplied to lines 214 and 240 by circuitry external to the development apparatus, actuating relay 232 and solenoids 234 and 242. Actuation of relay 232 closes normally open contacts 218 conducting power to armature 226 of motor 228 via contacts 224. Energization of solenoid 234 causes the wiper blade assembly retaining (anchor) mechanism to be released, allowing the assembly to move. At the same time, energization of solenoid 242 engages the drive shaft clutch 144 which couples the development electrode drive shaft 153 (FIG. 1) to engage the wiper blade assembly. Therefore, motor 228 now initiates the movement of the wiper assembly and the development electrode. When the wiper blade assembly leaves its initial position, normally open contacts 224 close. Since relay 232 is actuated, contacts 246 also close. The power from source 248 is now connected to solenoid 242 and line 240, locking in line 240 which is electrically connected to operate the purge blower, contacts 246 and solenoid 234 until contacts 244 reopen when the wiper assembly reaches its home position. Contacts 244 are part of a mechanical switch 191 (FIG. 3) which is actuated (closed) once each revolution of shaft 151 by pin 189 on gear member 187.

When the wiper blade assembly reaches its initial position, contacts 244 open, disconnecting power supply 248 and disengaging solenoid 242 (power on line 240 from external circuitry is only applied to remove wiper assembly from home position). Line 214 is disconnected when line 240 is disconnected at the termination of the purge cycle, deactuating solenoid 234 and thereby mechanically locking, via anchor 146, the wiper assembly at the initial position and disengaging clutch 144. The development electrode continues to move until it reaches its initial position since power is no longer directed through contacts 218.

It should be noted that the present invention is not limited to medical diagnostic applications but may be utilized in industrial applications (i.e., non-destructive testing of an article of manufacture using X-ray imaging) and may be utilized in any system which requires the development of a latent electrostatic image formed on an insulating surface.

While the invention has been described with reference to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the present invention without departing from its essential teachings.

What is claimed is:

1. An apparatus for selectively developing a latent electrostatic image formed on the surface of an insulating member in either a first or second mode, said insulating member overlying a conductive substrate, comprising:

a chamber having a pair of opposed sidewalls, means for supporting said insulating member, said surface facing said chamber, means for supplying a cloud of charged developer particles to said chamber through a port in one of said opposed sidewalls, means for supplying gas to said chamber through a port in the other of said opposed sidewalls, means overlying said ports through which said developer particles and said gas are introduced into said chamber whereby said gas and developer particles are mixed and are directed thereto to said insulating surface for a predetermined time period to develop said latent electrostatic image, a development electrode positioned between said insulating surface and said overlying means, said development electrode adapted for movement in said first development mode past said insulating surface during said development period, said development electrode being stationary in said second development mode and out of operable relationship with said insulating member, drive means for moving said development electrode past said insulating surface in said first development mode, means responsive to signals external to said apparatus for selecting either said first or second development modes, and means for biasing said conductive substrate to a predetermined polarity whereby said latent electrostatic image is developed in the selected mode.

2. The apparatus as defined in claim 1 wherein said development electrode is biased to the same polarity as said conductive substrate in said first development mode.

3. The apparatus as defined in claim 2 wherein the magnitude of the bias applied to the substrate is at least equal to the magnitude of the bias applied to said development electrode.

4. The apparatus as defined in claim 1 wherein said insulating member comprises a photoconductive layer overlying said conductive substrate.

5. The apparatus as defined in claim 1 wherein said development electrode comprises a plurality of spaced, substantially parallel conducting elements, a gap being formed between selected ones of said elements, said elements extending across the area of the insulating surface upon which the latent electrostatic image is formed.

6. The apparatus as defined in claim 5 wherein the area of said gap is at least equal to the area of the insulating surface upon which the latent electrostatic image is formed.

7. The apparatus as defined in claim 6 wherein said spaced, substantially parallel conducting elements are coupled at each end to a continuous loop member, said drive means being coupled to said continuous loop members whereby said development electrode is caused to move past said insulating surface in said first development mode in a direction substantially perpendicular to the axis of said parallel conducting elements, said development electrode being stationary in said second development mode with the gap being substantially coextensive with the area of the insulating surface upon which the latent electrostatic image is formed.

8. The apparatus as defined in claim 7 wherein said drive means comprises a variable speed motor whereby the speed at which said development electrode moves past said insulating surface in said first development mode is controlled.

9. The apparatus as defined in claim 7 further including an adjustable camming surface positioned adjacent at least one of said continuous loop members, the plane of the development electrode as it traverses the insulating surface in said first development mode being controlled whereby a predetermined spacing is maintained between said insulating surface and said development electrode.

10. The apparatus as defined in claim 9 further including said development electrode biasing means comprising a conductive element formed on said camming surface and an electrical potential applied thereto, said parallel conducting elements contacting said conductive element as they move past said insulating surface in said first development mode.

11. The apparatus as defined in claim 1 further including means for cleaning developer particles from said parallel conducting elements.

12. The apparatus as defined in claim 11 wherein said cleaning mean comprises at least one brush member positioned at a location remote from said insulating surface.

13. The apparatus as defined in claim 1 wherein said means for supplying charged developer particles and said means for supplying gas to said chamber are pulsed intermittently.

14. The apparatus as defined in claim 13 wherein the pulsing of said developer particle supply means and said gas supply means occur substantially simultaneously.

15. The apparatus as defined in claim 1 further including means for cleaning said overlying means and the bottom of said chamber, in sequence, subsequent to the development of said latent electrostatic image.

16. Apparatus for selectively developing a latent electrostatic image formed on the surface of an insulating member in either a first or second mode said insulating member overlying a conductive substrate comprising:

a chamber having a pair of opposed sidewalls and support means for supporting said insulating member such that said insulating surface faces said chamber, means for supplying a cloud of charged developer particles to said chamber through a port in one of said opposed sidewalls, means for supplying gas to said chamber through at least one port in the other of said opposed sidewalls, a baffle overlying said ports through which said developer particles and said gas are introduced into said chamber whereby said gas and developer particles mix under said baffle and are caused to move towards said insulating surface during a predetermined time period to develop said latent electrostatic image, a development electrode positioned between said insulating surface and said baffle, said development electrode adapted for movement in said first development mode past insulating surface during said development period, said development electrode being stationary in said second development mode and out of operable relationship with said insulating member, drive means for moving said development electrode past said insulating surface in said first development mode, means responsive to signals external to said apparatus for selecting either said first or second development modes, means for positioning said development electrode to a predetermined spacing from said insulating surface as it moves therepast in said first development mode, and means for biasing said conductive substrate to a predetermined polarity whereby said latent electrostatic image is developed.

17. The apparatus as defined in claim 16 further including means for removing from the chamber developer particles which have not developed said latent electrostatic image.

18. The apparatus as defined in claim 16 wherein said development electrode is biased to the same polarity as said conductive substrate in said first development mode.

19. The apparatus as defined in claim 18 wherein the magnitude of the bias applied to said substrate is at least equal to the magnitude of the bias applied to said development electrode.

20. The apparatus as defined in claim 16 wherein said insulating member comprises a photoconductive layer overlying said conductive substrate.

21. The apparatus as defined in claim 16 wherein said development electrode comprises a plurality of spaced, substantially parallel conducting elements, a gap being formed between selected ones of said elements, said elements extending across the area of the insulating surface upon which the latent electrostatic image is formed.

22. The apparatus as defined in claim 21 wherein the area of said gap is at least equal to the area of the insulating surface upon which the latent electrostatic image is formed.

23. The apparatus as defined in claim 22 wherein said spaced, substantially parallel conducting elements are coupled at each end to a continuous loop member, said drive means being coupled to said continuous loop members whereby said development electrode is caused to move past said insulating surface in first development mode in a direction substantially perpendicular to the axis of said parallel conducting elements, said development electrode being stationary in said second development mode with the gap being substantially coextensive with the area of the insulating surface upon which the latent electrostatic image is formed.

24. The apparatus as defined in claim 23 wherein said drive means comprises a variable speed motor whereby the speed at which said development electrode moves past said insulating surface in said first development mode is controlled.

25. The apparatus as defined in claim 16 further including cleaning means for cleaning developer particles from said parallel conducting elements, said cleaning means comprising at least one brush member positioned at a location remote from said insulating surface.

26. The apparatus as defined in claim 16 wherein said means for supplying charged developer particles and said means for supplying gas to said chamber are pulsed intermittently, the pulsing of said developer particle supply means and said gas supply means occurring substantially simultaneously.

27. The apparatus as defined in claim 16 wherein said baffle extends completely from one of said opposed sidewalls to the other of said sidewalls.

28. The apparatus as defined in claim 16 further including means for cleaning said baffle means and the bottom of said chamber, in sequence, subsequent to the development of said latent electrostatic image.

* * * * *